US007413837B2

(12) United States Patent
Yasumatsu et al.

(10) Patent No.: US 7,413,837 B2
(45) Date of Patent: Aug. 19, 2008

(54) CHARGE CONTROL AGENT AND TONER FOR ELECTROSTATIC IMAGE DEVELOPMENT CONTAINING THE SAME

(75) Inventors: Masashi Yasumatsu, Neyagawa (JP); Toshihiro Urakawa, Neyagawa (JP); Akihiro Tada, Neyagawa (JP)

(73) Assignee: Orient Chemical Industries, Ltd., Osaka (JP)

( * ) Notice: Subject to any disclaimer, the term of this patent is extended or adjusted under 35 U.S.C. 154(b) by 0 days.

(21) Appl. No.: 10/507,299

(22) PCT Filed: Mar. 18, 2003

(86) PCT No.: PCT/JP03/03252

§ 371 (c)(1),
(2), (4) Date: Sep. 10, 2004

(87) PCT Pub. No.: WO03/081341

PCT Pub. Date: Oct. 2, 2003

(65) Prior Publication Data

US 2005/0208409 A1 Sep. 22, 2005

(30) Foreign Application Priority Data

Mar. 22, 2002 (JP) ..... 2002-081513

(51) Int. Cl.
*G03G 9/097* (2006.01)

(52) U.S. Cl. ..... 430/108.23

(58) Field of Classification Search ..... 430/108.23; 534/713, 721

See application file for complete search history.

(56) References Cited

U.S. PATENT DOCUMENTS

| | | | | |
|---|---|---|---|---|
| 3,923,453 | A * | 12/1975 | Lazar et al. | 8/611 |
| 4,005,065 | A * | 1/1977 | Beffa et al. | 534/696 |
| 4,314,815 | A * | 2/1982 | Mollet | 8/524 |
| 4,427,585 | A | 1/1984 | Beffa | 260/151 |
| 5,077,168 | A * | 12/1991 | Ogami et al. | 430/108.23 |
| 5,204,453 | A * | 4/1993 | Chambon et al. | 534/602 |
| 5,500,318 | A * | 3/1996 | Tanikawa et al. | 430/99 |

FOREIGN PATENT DOCUMENTS

| | | |
|---|---|---|
| EP | 141 377 | 5/1985 |
| JP | 59-64851 | 4/1984 |
| JP | 63-267793 | 11/1988 |
| JP | 07-097530 | 4/1995 |
| JP | 09-169919 | 6/1997 |
| JP | 10-186713 | 7/1998 |
| JP | 11-007164 | 1/1999 |
| JP | 2001-026337 | 1/2001 |

OTHER PUBLICATIONS

American Chemical Society (ACS) File Registry No. (RN) 12218-94-9 on STN, which was entered in STN on Nov. 16, 1984.*

* cited by examiner

*Primary Examiner*—Janis L Dote
(74) *Attorney, Agent, or Firm*—Steptoe & Johnson LLP

(57) ABSTRACT

A charge control agent comprises a monoazo metals-compound including a monoazo compound represented by the following formula [I]:

[I]

and metals of a metallic element or a metalloid coordinating to the monoazo compound. A toner for developing an electrostatic image comprises: the charge control agent including the monoazo compound and metals of the metallic element or the metalloid coordinating to the monoazo compound, a resin for the toner and a colorant.

4 Claims, 2 Drawing Sheets

CHARGE CONTROL AGENT AND TONER FOR ELECTROSTATIC IMAGE DEVELOPMENT CONTAINING THE SAME

BACKGROUND OF THE INVENTION

This invention relates to a charge control agent for electro photography including a monoazo metals-compound and a toner for developing an electrostatic image including the agent.

An electro photography system performs to develop an electrostatic latent image by toner which are carried out frictional electrification, transferring and fixing toner image onto paper, to obtain images and characters.

In order for obtaining high resolution images, fine pulverized toner or resins having a high acid value therefor are used. If the pulverized toner had insufficient electrostatic charge, the toner image cannot be developed vividly and may cause foggy. For giving a sufficient frictional electrification property, a charge control agent is pre-added to the toner. It is known as the charge control agent having a negative electrification property, metallic complex salts of monoazo dyes, metallic complex salts of salicylic acid or naphthoic acid or dicarboxylic acid, copper phthalocyanine pigments and resins including acids-component. It is known as the charge control agent having a positive electrification property, nigrosine dyes, azine type dyes, triphenylmethane type dyes, resins of quaternary ammonium salt and resins having quaternary ammonium groups at a side chain thereof.

For instance, the metallic complex salts of monoazo dyes are mentioned in Japanese Patent Provisional Publication Nos. 63-267793, 7-97530, 9-169919, 10-186713, 11-7164 and 2001-26337.

However, the conventional charge control agents may decompose and deteriorate to lose a charge control property and make poor stability when being exposed to mechanical friction, mechanical shock, electric shock, optical irradiation, temperature change, high temperature, humidity change or high humidity. Moreover, when the toner image is transferred and fixed onto the paper with heat or pressure, the resins having a high acid value in the toner may make the charge control agent decompose or sublimate to cause the image on the paper to be indistinct. Furthermore, the rise speed of the electrification is so slow that the electrostatic charge becomes insufficient in an early stage of the development, thus the toner image is not developed vividly and will deteriorate on the way of the development.

The present invention has been developed to solve the foregoing problems.

It is an object of the present invention to provide charge control agent for electro photography including monoazo metals-compound which causes the sufficient frictional electrification property for the toner, excellent thermal resistance, excellent moisture resistance, stability and hardy sublimation. It is another object of the present invention to provide the toner including this compound for the electrostatic image development which causes resistance of mechanical friction, mechanical shock, electric shock and optical irradiation, promotion of fast rise speed of the electrification and of good quality of the developed toner image.

SUMMARY OF THE INVENTION

A charge control agent of the present invention developed for accomplishing the foregoing object, comprises: a monoazo metals-compound including a monoazo compound represented by the following chemical formula [I]

[I]

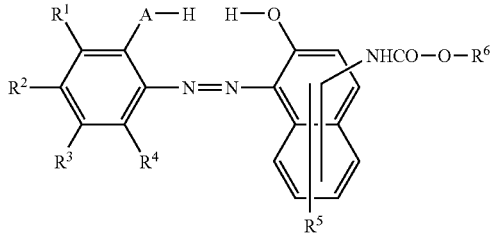

in the formula [I], $R^1$—, $R^2$—, $R^3$— and $R^4$— are same or different to each other, and one thereof is selected from the groups consisting of a hydrogen atom, an alkyl group of a straight chain or a branch chain having 1 to 18 carbon atoms, an alkenyl group of a straight chain or a branch chain having 2 to 18 carbon atoms, an aryl group being to have substitutional groups, a sulfonamide group being to substitute alkyl groups, a mesyl group, a hydroxyl group, an alkoxyl group having 1 to 18 carbon atoms, an acetylamino group, a benzoylamino group, a halogen atom, a nitro group and —COO—$R^7$ of which —$R^7$ is a hydrogen atom or an alkyl group, -A- is —O— or —COO—, —$R^5$ is a hydrogen atom, an alkyl group of a straight chain or a branch chain having 1 to 18 carbon atoms, an alkenyl group of a straight chain or a branch chain having 2 to 18 carbon atoms, an aryl group being to have substitutional groups, an aralkyl group being to have substitutional groups, a sulfonamide group, a mesyl group, a hydroxyl group, an alkoxyl group having 1 to 18 carbon atoms, a carboxyl group or a sulfone group, —$R^6$ is a hydrogen atom, an alkyl group of a straight chain or a branch chain having 1 to 18 carbon atoms, an alkenyl group of a straight chain or a branch chain having 2 to 18 carbon atoms, an aryl group being to have substitutional groups, an aralkyl group being to have substitutional groups or an alkoxyl group having 1 to 18 carbon atoms; and metals of a metallic element or a metalloid coordinating to the monoazo compound.

This monoazo metals-compound can be synthesized simply. The compound is used for the charge control agent which causes the sufficient frictional electrification property.

The monoazo metals-compound is preferably represented following chemical formula [II]

[II]

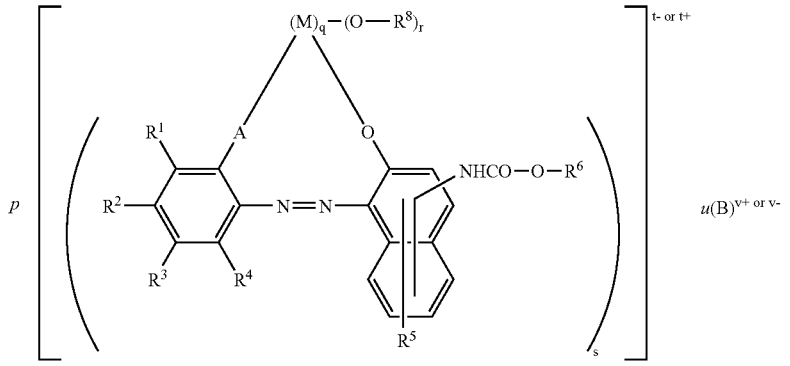

in the formula [II], $R^1$—, $R^2$—, $R^3$—, $R^4$—, $R^5$—, $R^6$— and -A- are the same as in the formula [I], p ranges from 1 to 2, $(M)_q$ wherein M is metals selected from a bivalent, trivalent or tetravalent metallic element and a metalloid of boron or silicon, q ranges from 1 to 4, —$(O—R^8)_r$ wherein —$R^8$ is an alkyl group having 1 to 8 carbon atoms or an aryl group, r ranges from 0 to 3, s ranges from 1 to 6, t ranges from 0 to 2, u ranges from 0 to 2, $(B)^{v+}$ is univalent or bivalent cation, and $(B)^{v-}$ is univalent or bivalent anion.

For example, $(B)^{v+}$ is a hydrogen ion, an ammonium ion, a primary to quaternary organic ammonium ion and/or an alkali metal cation. For example $(B)^{v-}$ is an organic sulfonate anion, an organic carboxylate anion, $Cl^-$, $OH^-$, $SO_4^{2-}$ and/or $NO_3$—.

The monoazo compound represented the above formula [I] and metals-complexing agent are reacted to obtain the monoazo metals-compound represented the above formula [II].

In the above formula [II], when the metals M is the trivalent or tetravalent metallic element, the monoazo metals-compound tends to form a structure wherein q is 1 and s is 2, or a structure wherein q is 2 and s is 3. When the metals M is a bivalent alkaline earth metallic element, the monoazo metals-compound tends to form a structure wherein q is 1 and s is 1. When the metals M is the metalloid of boron or silicon, the monoazo metals-compound tends to form a structure wherein q is 1 and s is 2.

The charge control agent is preferably including the monoazo metals-compound represented by the above formula [II] wherein q is 1 and s is 2. It is preferable that the agent has an average particle size ranging from 1 to 5 microns to cause faster rise speed of the electrification.

The charge control agent may include the monoazo metals-compound represented by the above formula [II] wherein the central metals M is the bivalent metallic element such as Fe, Zn, Sr, Ca or Mg; the trivalent metallic element such as Cr, Al, Fe, Ni, Co or Mn; the tetravalent metallic element such as Ti, Zr or Sn; or the metalloid such as boron or silicon.

The charge control agent more preferably includes the monoazo metals-compound represented by the above formula [I] wherein M is any metallic element of Fe, Al, Zr, Ti and Zn, because it brings about high safety to human organism.

If the monoazo metals-compound is contaminated with some non-coordinating monoazo compound, the electrification stability of the charge control agent is decreased.

The charge control agent preferably includes the monoazo metals-compound that has an average particle size ranging from 0.1 to 7 microns. Outside this range, the charge control agent cannot sufficiently mix to disperse and melt to knead into the binding resin for the toner.

The charge control agent is favorably used for the toner for developing the electrostatic image since the monoazo metals-compound causes the sufficient frictional electrification property, the excellent thermal resistance, the excellent moisture resistance, the high affinity and the sufficient dispersibility with the resin, the stability, the hardy sublimation, and the fast rise speed of the electrification.

The toner for developing the electrostatic image of this present invention includes the above charge control agent, the resin for the toner and colorant. The toner preferably includes 0.2 to 10 parts, more preferably 0.5 to 5 parts by weight of the charge control agent and 0.5 to 5 parts by weight of the colorant, per 100 parts by weight of the resin for the toner.

The resin for the toner is preferably a styrene-acryl resin, a styrene-maleic acid resin, a styrene-(meth)acrylate copolymer and/or a polyester resin, and it has an acid value of 5 to 50 mgKOH/g thereof. The resin is more preferably the polyester resin or the styrene-acryl resin, and it has the acid value ranging from 5 to 30 mgKOH/g thereof. For improving the electrification property and fixing property of the toner, average molecular weight thereof divided by number average molecular weight thereof is preferably ranging from 2 to 10. The exemplified resins for the toner may be used solely or plurally with suitable mixing.

The toner for developing the electrostatic image resists the friction and the shock, and causes the fast rise speed of the electrification. If temperature and humidity fluctuate, the toner maintains the excellent electrification stability for a long time.

DETAILED EXPLANATION OF THE INVENTION

Figure 1:
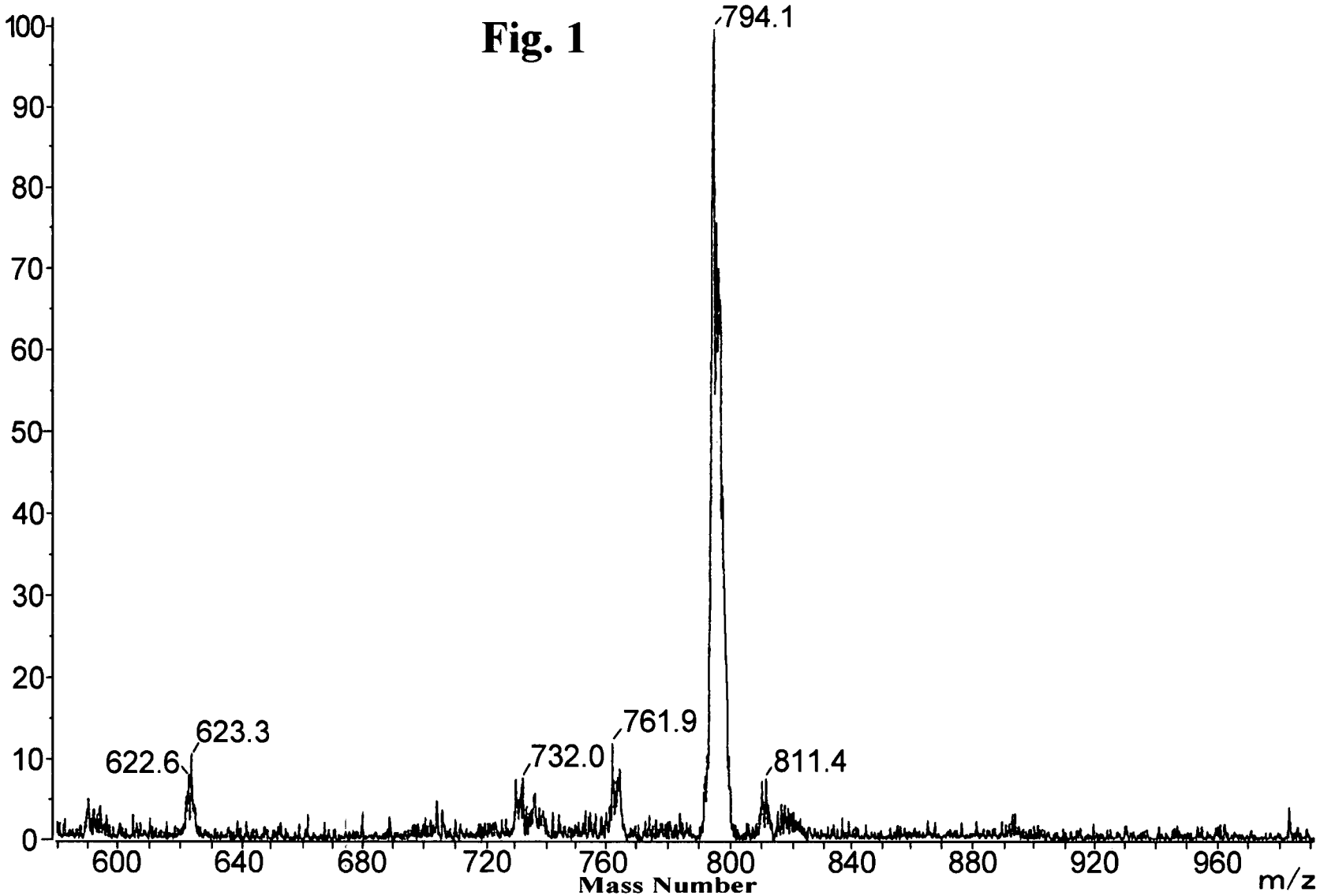
FIG. 1 is a fast atom bombardment mass spectrometry spectrum of the monoazo metals-compound which applies this invention.

Hereunder, embodiments of this invention are explained in detail.

The monoazo compound represented by the above chemical formula [I] is synthesized as follows.

A material is an aniline derivative represented by the following chemical formula [III]:

[III]

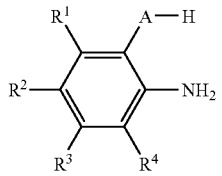

In the formula [III], $R^1$—, $R^2$—, $R^3$— and $R^4$— are same or different to each other, and one thereof is selected from the groups consisting of a hydrogen atom; an alkyl group of a straight chain or a branch chain having 1 to 18 carbon atoms such as methyl group, ethyl group, propyl group, isopropyl group, butyl group or tert-butyl group; an alkenyl group of a straight chain or a branch chain having 2 to 18 carbon atoms such as —$CH_2CH$═$CH_2$ or —$C(CH_3)$═$CH_2$; an aryl group such as phenyl group, tolyl group or naphthyl group, which may have a few substitutional groups for example halogen atom represented by F, Cl, Br and I, an alkyl group having 1 to 18 carbon atoms, or no substitutional group; a sulfonamide group which may substitute an alkyl group such as methyl group, ethyl group, propyl group or butyl group or none; a mesyl group; a hydroxyl group; an alkoxyl group having 1 to 18 carbon atoms such as methoxyl group, ethoxyl group, isopropoxyl group; an acetylamino group; a benzoylamino group; a halogen atom represented by F Cl, Br and I; a nitro group; and —COO—$R^7$ of which —$R^7$ is a hydrogen atom or an alkyl group having 1 to 8 carbon atoms. And -A- is —O— or —COO—.

The other material is a beta-naphthol derivative represented by the following chemical formula [IV]:

[IV]

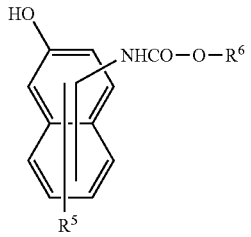

In the formula [IV], $R^5$— is selected from the groups consisting of a hydrogen atom; an alkyl group of a straight chain or a branch chain having 1 to 18 carbon atoms such as methyl group, ethyl group, propyl group, isopropyl group, butyl group or tert-butyl group; an alkenyl group of a straight chain or a branch chain having 2 to 18 carbon atoms; sulfonamide group; an aryl group such as phenyl group, tolyl group or naphthyl group, which may have a few substitutional groups for example halogen atom represented F, Cl, Br and I, an alkyl group having 1 to 18 carbon atoms, or no substitutional group; an aralkyl group such as benzyl group or alpha, alpha'-dimethylbenzyl group, which may have the above substitutional group or none; a sulfonamide group; a mesyl group; a hydroxyl group; an alkoxyl group having 1 to 18 carbon atoms such as methoxyl group, ethoxyl group or isopropoxyl group; an carboxyl group; and a sulfone group. $R^6$— is selected from the groups consisting of a hydrogen atom; an alkyl group of a straight chain or a branch chain having 1 to 18 carbon atoms such as methyl group, ethyl group, propyl group, isopropyl group, butyl group or tert-butyl group; an alkenyl group of a straight chain or a branch chain having 2 to 18 carbon atoms such as —$CH_2CH$═$CH_2$ or —$C(CH_3)$═$CH_2$; an aryl group such as phenyl group, tolyl group or naphthyl group, which may have a few substitutional groups for example halogen atom represented by F, Cl, Br and I, an alkyl group having 1 to 18 carbon atoms, or no substitutional group; an aralkyl group such as benzyl group or alpha,alpha'-dimethylbenzyl group may have the above substitutional group or none; an alkoxyl group having 1 to 18 carbon atoms such as ethoxyl group, isopropoxyl group. $R^6$— is more preferably methyl group, ethyl group, butyl group or phenyl group.

The aniline derivative represented by the above chemical formula [III] is carried out diazotization reaction. An obtained compound and the beta-naphthol represented by the above formula [IV] as coupling component are carried out diazo-coupling reaction in aqueous solution, organic solvent or mixed solution of water and organic solvent, to obtain the monoazo compound represented by the above formula [I].

It is featured that this monoazo compound has —NH—CO—O—$R^6$ and —$R^5$ at one of 3 to 8 positions of the beta-naphthol.

These monoazo compounds represented by the following chemical formula [I] are specified in Table 1, concretely.

TABLE 1

Examples of the Monoazo Compounds

[I]

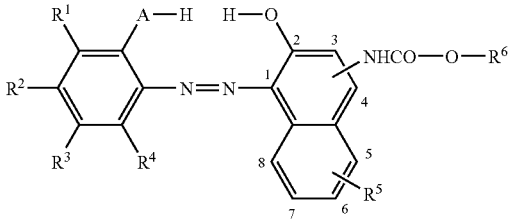

| Compound No. | —R¹ | —R² | —R³ | —R⁴ | —A— | —R⁵ Position | —R⁵ —R⁶group | —NHCO—O—R⁶ Position | —NHCO—O—R⁶ —R⁶group |
|---|---|---|---|---|---|---|---|---|---|
| I-1 | —H | —H | —Cl | —H | —O— | — | —H | 8 | —$CH_3$ |
| I-2 | —H | —H | —Cl | —H | —COO— | — | —H | 8 | —$CH_3$ |
| I-3 | —H | —H | -tert-$C_4H_9$ | —H | —O— | — | —H | 8 | —$C_2H_5$ |
| I-4 | —H | —H | —$SO_2NH_2$ | —H | —O— | — | —H | 8 | -iso-$C_4H_9$ |
| I-5 | —Cl | —H | —Cl | —H | —O— | — | —H | 8 | —$CH_2$—$C_6H_5$ |
| I-6 | —H | —$SO_2NH_2$ | —Cl | —H | —O— | — | —H | 8 | —$C_6H_5$ |
| I-7 | —H | —H | —F | —H | —O— | — | —H | 8 | —$CH_2CH$═$CH_2$ |
| I-8 | —H | —H | —Cl | —H | —O— | — | —H | 8 | —$CH_2$—Br |
| I-9 | —COOH | —H | —H | —H | —O— | — | —H | 8 | -n-$C_4H_9$ |
| I-10 | —H | —H | —$C_6H_5$ | —H | —O— | — | —H | 8 | —$CH_2$—$CCl_3$ |
| I-11 | —H | —H | —Cl | —H | —O— | — | —H | 3 | —$CH_3$ |
| I-12 | —H | —H | —Cl | —H | —O— | 6 | -tert-$C_4H_9$ | 3 | —$CH_3$ |
| I-13 | —H | —H | —Cl | —H | —COO— | — | —H | 3 | —$C_2H_5$ |
| I-14 | —H | —H | —F | —H | —O— | 6 | -n-$C_4H_9$ | 3 | -n-$C_4H_9$ |
| I-15 | —H | —$SO_2NH_2$ | —Cl | —H | —O— | — | —H | 6 | -n-$C_4H_9$ |
| I-16 | —H | —H | —Cl | —H | —O— | — | —H | 5 | —$CH_3$ |
| I-17 | —H | —H | —$SO_2NH_2$ | —H | —O— | 4 | —OH | 7 | —$CH_2$—$C_6H_5$ |
| I-18 | —H | —H | —F | —H | —O— | — | —H | 7 | -iso-$C_3H_7$ |
| I-19 | —$NO_2$ | —H | —$NO_2$ | —H | —O— | — | —H | 8 | -tert-$C_4H_9$ |
| I-20 | —H | —H | —F | —H | —O— | 3 | —COOH | 7 | -tert-$C_8H_{17}$ |
| I-21 | —H | —$SO_2NH_2$ | —Cl | —H | —O— | — | —H | 8 | —$CH_3$ |
| I-22 | —H | —H | —Cl | —H | —O— | — | —H | 8 | —$C_2H_5$ |
| I-23 | —H | —H | —Cl | —H | —O— | 5 | -tert-$C_8H_{17}$ | 8 | —$CH_3$ |
| I-24 | —H | —H | —Br | —H | —O— | — | —H | 3 | —$CH_3$ |
| I-25 | —H | —H | —$SO_2NH_2$ | —H | —O— | — | —H | 8 | —$CH_3$ |
| I-26 | —H | —H | —Br | —H | —O— | — | —H | 8 | —$CH_3$ |
| I-27 | —H | —H | -tert-$C_4H_9$ | —H | —O— | — | —H | 8 | —$CH_3$ |

Both of the formula [I] at Table 1 and the formula [I] according to claims are shown the same chemical structure, although each of illustrated styles of the corresponding bonding-groups is partially different.

The monoazo metals-compounds represented by the above formula [II] are synthesized from these monoazo compounds as follows.

The monoazo compound and the metals-complexing agent are reacted in water, organic solvent or mixture of water and organic solvent, whereupon the monoazo compound is coordinated to the metals. Formed product is dispersed in water for instance, to deposit. It is filtrated, washed with water and desiccated, to obtain the monoazo metals-compound for the charge control agent.

Incidentally when they are reacted in organic solvent, formed product is deposited. It is only filtrated to obtain the monoazo metals-compound represented by above chemical formula [II].

Specific examples of the organic solvent used for obtaining the monoazo metals-compound are alcohols or ethers or glycols such as methanol, ethanol, ethylene glycol monomethyl ether, ethylene glycol monoethyl ether, propylene glycol monomethyl ether, ethylene glycol dimethyl ether: monoglyme, diethylene glycol dimethyl ether: diglyme, ethylene glycol diethyl ether, triethylene glycol dimethyl ether: triglyme, tetraethylene glycol dimethyl ether: tetraglyme, ethylene glycol, diethylene glycol, or propylene glycol; aprotic solvent such as N,N-dimethyl formamide, N,N-dimethyl acetamide, N-methyl-2-pyrrolidone or dimethyl sulfoxide.

The metals-complexing agent is for example a metallic element-complexing agent or a metalloid-complexing agent.

Specific examples of the metallic element-complexing agent are aluminum compounds such as aluminum sulfate, aluminum tripropoxide, aluminum tributoxide or basic aluminum acetate; chromium compounds such as chromium formate, chromium acetate, chromium sulfate, chromium chloride or chromium nitrate; iron compounds such as iron (II) chloride, iron(III) chloride, iron(III) sulfate, iron(III) nitrate or iron triethoxide; cobalt compounds such as cobalt chloride, cobalt nitrate or cobalt sulfate; titanium compounds such as titanium chloride, titanium tetrabutoxide or titanium tetraisopropoxide; and zinc compounds such as zinc chloride or zinc sulfate.

Specific examples of the metalloid-complexing agent are a boron-complexing agent like a boron compound such as trimethoxyborane or tripropoxyborane; and silicon-complexing agent like silicon compounds such as tetraisopropoxysilane or tetraphenoxysilane.

The metals-complexing agent may be metal alkoxide; metal-coupling agent such as a titanate type coupling agent or an aluminum type coupling agent; boron alkoxide; silicon alkoxide; a silane coupling agent. When these alkoxides and so on are used, the monoazo metals-compound whose the ligands coordinating to the metals completely exchange with the alkoxyl groups of the alkoxides is obtained occasionally.

Preferably the metals-complexing agent ranging from ⅓ to 2 atom equivalents of the metals is used per 1 equivalent of the monoazo compound. More preferably the agent ranging from ½ to ⅔ atom equivalents thereof is used.

The monoazo metals-compound is formed one of various structures represented by above formula [II] which s molecules of the monoazo compound are coordinated to q atoms of metals M, according to species and valence of the metals of the metals-complexing agent, pH condition when it is synthesized, and pH condition when it is deposited and filtrated.

The monoazo metals-compound may have no counter ion, or several counter ions such as $(B)^{v+}$ or $(B)^{v-}$.

The existence and species of the counter ion of the monoazo metals-compound varies, according to coexistent ion species and pH condition when it is synthesized, or pH condition when it is deposited and filtrated. For example, when the monoazo metals-compound is deposited and filtrated under acidic condition in hydrochloric acid solution, the counter ion $(B)^{v+}$ is $H^+$. When it is carried out under strong basic condition in sodium hydroxide solution, the counter ion $(B)^{v+}$ is $Na^+$. When it is carried out under weak basic and approximate neutral condition in diluted sodium hydroxide solution, the counter ion $(B)^{v+}$ is the mixture of $H^+$ and $Na^+$.

Moreover, when the metal alkoxide or the metalloid alkoxide as the metals-complexing agent is used, the central metals M of the monoazo metals-compound can bond to each of the monoazo compound and the alkoxyl group partially. Consequently a valence thereof and a coefficient of the counter ion $(B)^{v+}$ or $(B)^{v-}$ are univocally determined according to the numbers of the bonding alkoxyl group and the species of the counter ion.

The monoazo metals-compounds are identified by mass spectrometry such as fast atom bombardment mass spectrometry: FAB-MS.

The monoazo metals-compounds are not decomposed and sublimated by heating because —NHCO—O—$R^6$ group bonding to the beta-naphthol of the monoazo compound causes excellent thermal resistance.

The monoazo metals-compounds represented by the following chemical formula [I] are specified in Table 2, concretely.

TABLE 2

Examples of the Monoazo Metals-compounds

[II]

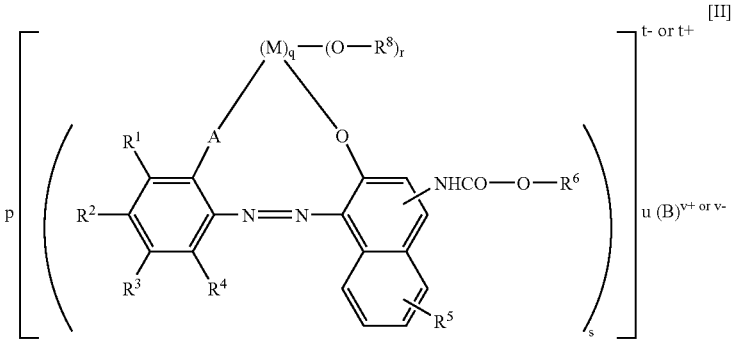

| Compound No. | p | Monoazo Compound | s | M | q | —$(OR^8)_r$ | t− or t+ | u | $(B)^{v+}$ or $(B)^{v-}$ |
|---|---|---|---|---|---|---|---|---|---|
| II-1 | 1 | I-1 | 2 | Fe | 1 | — | 1− | 1 | $Na^+$ |
| II-2 | 1 | I-3 | 2 | Al | 1 | — | 1− | 1 | $NH_4^+$ |
| II-3 | 1 | I-4 | 3 | Fe | 2 | — | 0 | 2 | — |
| II-4 | 1 | I-5 | 2 | Zn | 1 | — | 2− | 1 | $H^+$ |
| II-5 | 1 | I-6 | 3 | Zn | 2 | — | 0 | 1 | — |
| II-6 | 1 | I-7 | 3 | Al | 2 | — | 0 | 1 | — |
| II-7 | 1 | I-8 | 1 | Ca | 1 | — | 0 | 1 | — |
| II-8 | 1 | I-9 | 1 | Mg | 1 | — | 0 | 1 | — |
| II-9 | 1 | I-10 | 1 | Zr | 1 | — | 0 | 1 | — |
| II-10 | 1 | I-1 | 2 | Al | 1 | — | 1− | 1 | $H^+$ |
| II-11 | 1 | I-1 | 2 | Fe | 1 | — | 1− | 1 | $H^+$ |
| II-12 | 1 | I-21 | 2 | Fe | 1 | — | 1− | 1 | $NH_4^+$ |
| II-13 | 1 | I-22 | 2 | Fe | 1 | — | 1− | 1 | $H^+$ |
| II-14 | 1 | I-11 | 2 | Fe | 1 | — | 1− | 1 | $Na^+$ |
| II-15 | 1 | I-12 | 2 | Fe | 1 | — | 1− | 1 | $H^+$ |
| II-16 | 1 | I-11 | 3 | Fe | 2 | — | 0 | 1 | — |
| II-17 | 1 | I-16 | 1 | Zn | 1 | — | 0 | 1 | — |
| II-18 | 1 | I-19 | 2 | Fe | 1 | — | 1− | 1 | $NH_4^+$ |
| II-19 | 1 | I-15 | 2 | Fe | 1 | — | 1− | 1 | $C_{12}H_{25}NH_3^+$ |
| II-20 | 1 | I-19 | 2 | Al | 1 | — | 1− | 1 | $H^+$ |
| II-21 | 1 | I-1 | 2 | Cr | 1 | — | 1− | 1 | $H^+$ |
| II-22 | 1 | I-25 | 2 | Fe | 1 | — | 1− | 1 | $(C_6H_5CH_2)(CH_3)_3N^+$ |
| II-23 | 1 | I-1 | 2 | Si | 1 | — | 0 | 1 | — |
| II-24 | 1 | I-1 | 2 | B | 1 | — | 1− | 1 | $H^+$ |

TABLE 2-continued

Examples of the Monoazo Metals-compounds

[II]

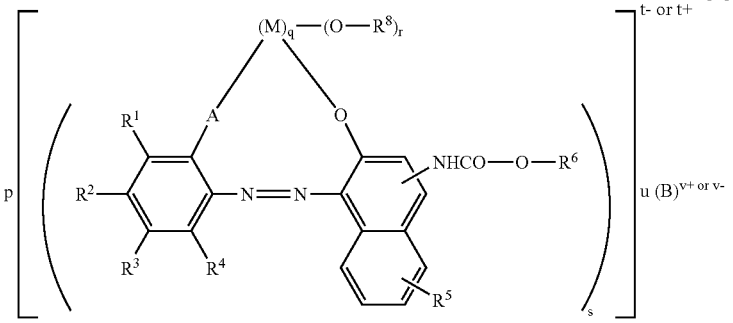

| Compound No. | p | Monoazo Compound | s | M | q | —(OR$^8$)$_r$ | t− or t+ | u | (B)$^{v+}$ or (B)$^{v-}$ |
|---|---|---|---|---|---|---|---|---|---|
| II-25 | 1 | I-6 | 2 | B | 1 | — | 1− | 1 | $NH_4^+$ |
| II-26 | 1 | I-3 | 2 | Al | 1 | — | 1− | 1 | $H^+$ |
| II-27 | 1 | I-23 | 2 | Fe | 1 | — | 1− | 1 | $NH_4^+$ |

Both of the formula [II] at Table 2 and the formula [II] according to claims are shown the same chemical structure, although each of illustrated styles of the corresponding bonding-groups is are partially different.

More structural formulas of other monoazo metals-compounds synthesized from the monoazo compound represented by the following chemical formula: Compound No. I-1 in Table 1 is shown.

(I-1)

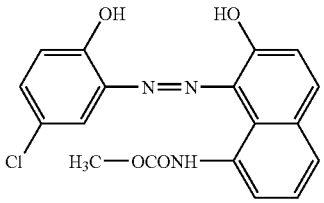

The following chemical formula II-27 is illustrated the monoazo iron-compound wherein a ratio of this monoazo compound to the metals Fe(III) is two to one.

(II-27)

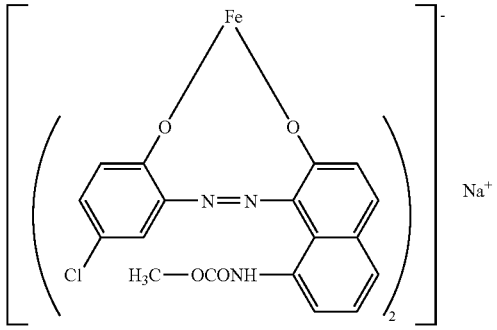

The following chemical formula II-28 is illustrated the monoazo iron-compound wherein a ratio of this monoazo compound to the metals Fe(III) is three to two.

(II-28)

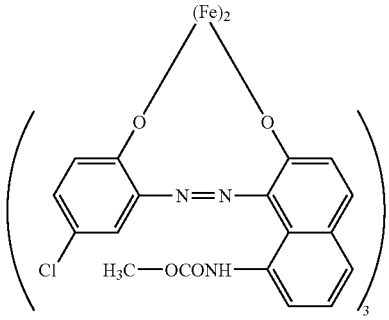

The following chemical formula II-29 is illustrated the monoazo aluminum-compound wherein a ratio of this monoazo compound to the metals Al(III) is two to one.

(II-29)

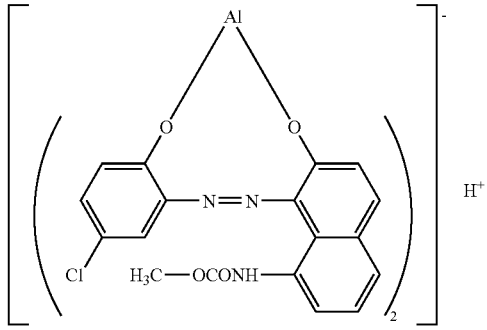

The following chemical formula II-30 is illustrated the monoazo calcium-compound wherein a ratio of this monoazo compound to the metals Ca(II) is one to one.

(II-30)

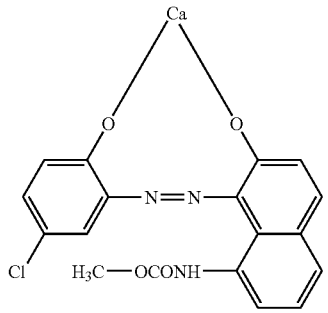

The following chemical formula II-31 is illustrated the monoazo titanium-compound wherein a ratio of this monoazo compound to the metals Ti(IV) is two to one.

(II-31)

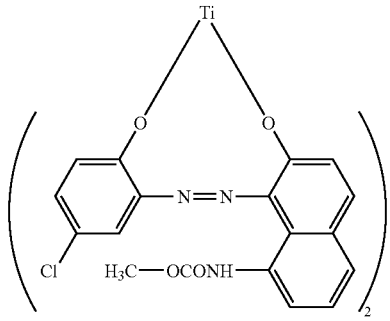

The following chemical formula II-32 is illustrated the monoazo zinc-compound wherein a ratio of this monoazo compound to the metals Zn(II) is two to one.

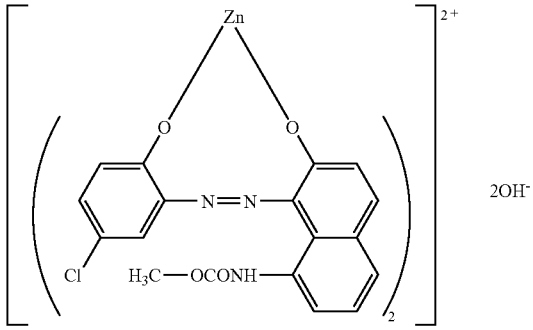

The following chemical formula II-33 is illustrated the monoazo boron-compound wherein a ratio of this monoazo compound to the metals B(III) is two to one.

(II-33)

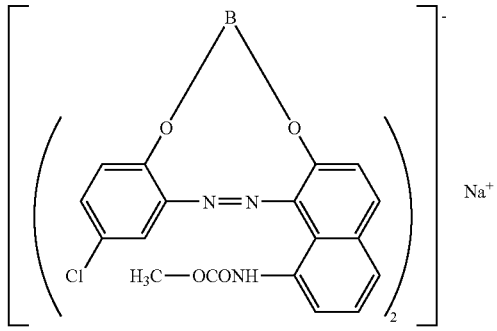

The following chemical formula II-34 is illustrated the monoazo aluminum-compound wherein a ratio of this monoazo compound to the metals Al(III) with the bonding alkoxyl group is one to one.

(II-34)

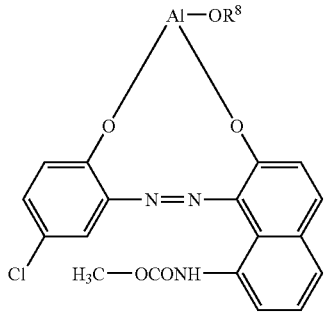

The following chemical formula II-35 is illustrated the monoazo titanium-compound wherein a ratio of this monoazo compound to the metals Ti(IV) with the bonding alkoxyl group is one to one.

(II-35)

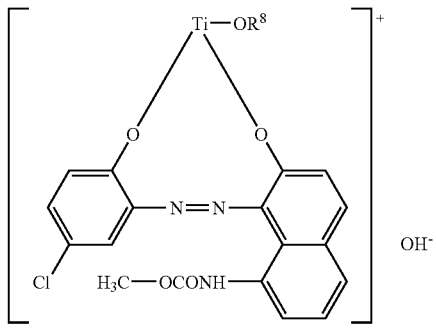

The following chemical formula II-36 is illustrated the monoazo silicon-compound wherein a ratio of this monoazo compound to the metals Si(IV) with the bonding alkoxyl groups is one to one.

(II-36)

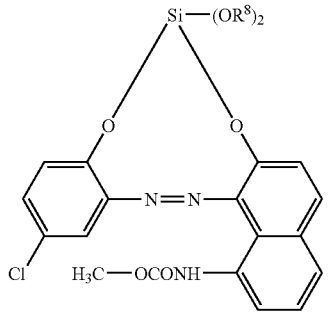

The charge control agent includes the monoazo metals-compound. The charge control agent may include sole monoazo metals-compound or plural monoazo metals-compounds whose structures are differed each other. The charge control agent may include other charge control agents such as metallic complex salt of monoazo dyes, or metal salicylate compounds which may have an alkyl group of a straight chain or a branch chain. Examples of the metal salicylate compounds are metal salicylate complex salts or metal salicylates whose metal is Fe, Al, Zn and Cr.

The toner for developing the electrostatic image is prepared from the charge control agent including the monoazo metals-containing compound as follows.

The charge control agent, the resin for the toner, the colorant, and an appropriate additive agent which is used to upgrade the toner if necessary, are sufficiently mixed by a blender such as a ball mill. It is kneaded with melting by a heat kneading machine such as a heating roll, a kneader or an extruder. After carrying out the cooling solidification thereof, it is granulated and classified, to obtain the toner for developing the electrostatic image had an average particle size ranging from 5 to 20 microns.

Otherwise, after the charge control agent, the colorant and the additive agent if necessary are dispersed into a solution of the resin for the toner, the toner for developing the electrostatic image can be obtained through spraying and drying thereof. And more otherwise, after the charge control agent, colorant and appropriate additive agents if necessary are mixed with a monomer which is able to polymerize and derive to a binder as the resin for the toner to prepare emulsifying suspension, the toner for developing the electrostatic image can be obtained through polymerization.

Examples of the colorant for the black toner are carbon black whose pH is ranged from acid to alkaline such as MA100, MA11, MA8, MA7, #40 or #44 which are all available from Mitsubishi Chemical Corporation; RAVEN 1250 which is available from Colombian Carbon Company; MONARCH 880, MOGUL L and MOGUL 660R which are all available from Cabot Corporation; color black FW2, special black 250 and PRINTEX 90 which are available from Degussa Corporation. Dyes or pigments may be used together with the carbon black.

Examples of the colorant for color toner, are organic pigments such as quinophtharone yellow, hansa yellow, isoindolinone yellow, perinone orange, perylene maroon, rhodamine 6G lake, quinacridone, anthanthrone red, rose bengale, copper phthalocyanine blue, copper phthalocyanine green or diketopyrrolopyrrole; inorganic pigments such as titanium white, titanium yellow, ultramarine, cobalt blue or red iron oxide. The above colorant may be used solely or plurally thereof. Dyes or other commercial pigments may be use together with the above pigments.

The additive agents may be added internally or externally. Examples of the additive agents are an offset inhibitor, a fluid improvement agent, a cleaning auxiliary, a conductive material according to the development mode of the toner image and particulates of magnetic substance. Examples of the offset inhibitor are a polyolefin wax such as low molecular weight polypropylene, polyethylene, oxygenated polypropylene or oxygenated polyethylene; a natural wax such as carnauba wax, rice wax or montan wax. It is preferably the wax whose average molecular weight is ranging from 500 to 15000. Examples of the fluid improvement agent are a metal oxide such as silica, aluminum oxide or titanium oxide; magnesium fluoride. Examples of the cleaning auxiliary are metallic soaps of stearic acid; particulates of synthetic resins such as a fluorine-contained synthetic resin, a silicone-contained synthetic resin or a styrene-(meth)acrylic synthetic resin. Examples of the conductive material are conductive carbon black, graphite. Examples of the particulates of magnetic substance are ferromagnetic particulates such as ferromagnetic metal like iron, cobalt or nickel; an alloy thereof; oxides such as ferrite thereof.

A two-component developer using the toner for developing the electrostatic image is prepared with mixing the toner and a carrier. This developer is used for developing by a two-component magnetic brush development method. Examples of the carrier are powder of iron or nickel or ferrite and glass beads whose particle size is ranging from 50 to 200 microns, the modified powder or the modified beads whose surfaces are coated with an acrylate copolymer, a styrene-acrylate copolymer, a styrene-methacrylate copolymer, a silicone resin, a polyamide resin or a fluoroethylenes-contained resin.

A mono-component developer using the toner for developing the electrostatic image is prepared with adding and dispersing appropriate ferromagnetic particulates such as powder of iron or nickel or ferrite on the occasion of the preparing of the toner. This developer is used for developing by a contact development method or a jumping development method.

Examples 1 to 5 which are applied this invention, show the synthesis of the monoazo compound, the synthesis of the monoazo metals-compound using thereof, the preparing the toner for developing the electrostatic image included monoazo metals-compound as the charge control agent, and the formation the image onto the paper using the toner. Comparative Examples 1 to 5 are applied out of this invention.

EXAMPLE 1

(1) Synthesis of the Monoazo Compound: Compound No. I-1

49.5 g of 4-chloro-2-aminophenol was added to a mixture of 119.8 g of 35.6% concentrated hydrochloric acid and 340 mL of 2-propanol with stirring. After it was cooling until 0 to 5 degrees centigrade, 66.85 g of 36.3% sodium nitrite aqueous solution was added thereto over 90 minutes at the same temperature. It was stirred for 90 minutes to carry out the diazotization reaction. The deposited sodium chloride was removed by filtration to obtain the filtrate including the diazo compound. The filtrate was added dropwise to a mixture of 340 mL of 2-propanol, 84.6 g of 48.86% sodium hydroxide aqueous solution and 74.8 g of 1-methoxycarboamido-7-naphthol at 0 to 5 degrees centigrade. With stirring for 90 minutes, it is carried out the coupling reaction. Concentrated hydrochloric acid was added to the reaction mixture until acidic. The mixture was filtrated to take out a precipitate. It was washed with water and dried, to obtain 95.8 g of the monoazo compound represented Compound No. I-1 in Table 1.

Subsequently, the confirmatory test of the sublimation of the monoazo compound was performed. 100 mg of the monoazo compound and 2 g of the resin having 19 mg KOH/g of the acid value were added into a 25 mL crucible, and mixed. A filter paper was put on the crucible. After the bottom of crucible was heated at 190 degrees centigrade for 1 hour, an under side of the filter paper was observed. It was not found accretions of red sublimates, so it was confirmed the monoazo compound had no sublimation property.

(2) Synthesis of the Monoazo Metals-Compound: Compound No. II-1

342 mL of methanol and 21.2 g of 48.86% sodium hydroxide aqueous solution was added to 40 g of the monoazo compound. It was refluxed at 68 degrees centigrade for 2 hours. After 21.59 g of 38.9% iron(III) chloride aqueous solution as the metals-complexing agent was added slowly, it was refluxed at 68 degrees centigrade for 2 hours to react. It was cooled until room temperature. The mixture was filtrated to take out a precipitate. It was washed with water and dried, to obtain 39.9 g of the monoazo metals-compound represented Compound No. II-1 in Table 2.

(II-1)

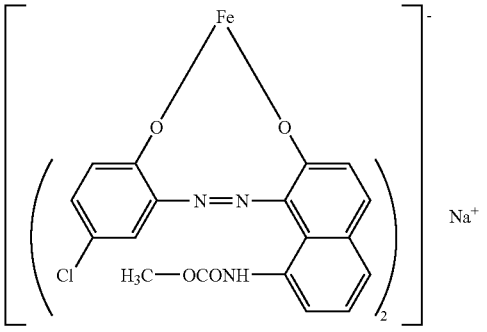

The structure of the monoazo metals-compound was confirmed by fast atom bombardment mass spectrometry measurement: FAB-MS. As a mass spectrograph, JMS-AX505HA which is available from Japan Electron Optics Laboratory Corporation was used. The measurement conditions were as follows;

using xenon gas resolution: 500, 50 to 2500 M/Z primary acceleration voltage: 6.0 kV secondary acceleration voltage: 2.5 kV ion multiplier: 2.2 kV.

The monoazo metals-compound was dissolved with a matrix: m-nitrobenzyl alcohol. About 20 mg thereof was applied onto a FAB target. It was measured using a xenon beam to obtain a FAB-MS spectrum shown FIG. 1. A measured value was 794.1. It was approximately agreed with a theoretical value 796.4 calculated except for the counter ion.

The counter ion thereof was identified with Na by atomic absorption analysis. And the average particle size of the monoazo metals-compound was 4 microns.

These results were estimated that the monoazo metals-compound was the monoazo iron-compound: Compound No. II-1 represented by the above formula whose ratio of the monoazo compound to metals Fe(III) was two to one.

Subsequently, the confirmatory test of the sublimation of the monoazo metals-compound was performed. 100 mg of the metals-compound and 2 g of the resin having 19 mg KOH/g of the acid value are added and mixed into a 25 mL crucible. A filter paper was put on the crucible. After the bottom of the crucible was heated at 190 degrees centigrade for 1 hour, the under side of the filter paper was observed. It was not found accretions of sublimates, so it was confirmed that the metals-compound had no sublimation property.

(3) Preparation of the Toner for Developing the Electrostatic Image 1 part by weight of the monoazo metals-compound: Compound No. II-1 as the charge control agent, 100 parts by weight of polyester resin for the toner: HP-301 which is available from Nippon Synthetic Chemical Industry Corporation, 2 parts by weight of low molecular weight polypropylene resin for the toner: VISCOL 550P which is available from Sanyo Kasei Industries Corporation, and 6 parts by weight of carbon black as the colorant: MA-100 which is available from Mitsubishi Chemical Corporation were mixed preliminarily using a high speed mixer, to prepare a homogeneous pre-mix. The pre-mix was kneaded with melting by a heating roll. It was cooled, and granulated roughly by an ultracentrifugal granulator. The prepared rough granules were granulated finely by an air jet mill equipping with a classifier, to obtain the toner for developing the electrostatic image having about 10 microns of the average particle size thereof.

(4) Formation of Images onto the Paper 5 parts by weight of the obtained toner and 100 parts by weight of carrier of iron powder: TEFV200/300 which is available from Powder Tech Corporation were mixed to prepare the developer.

Figure 2:
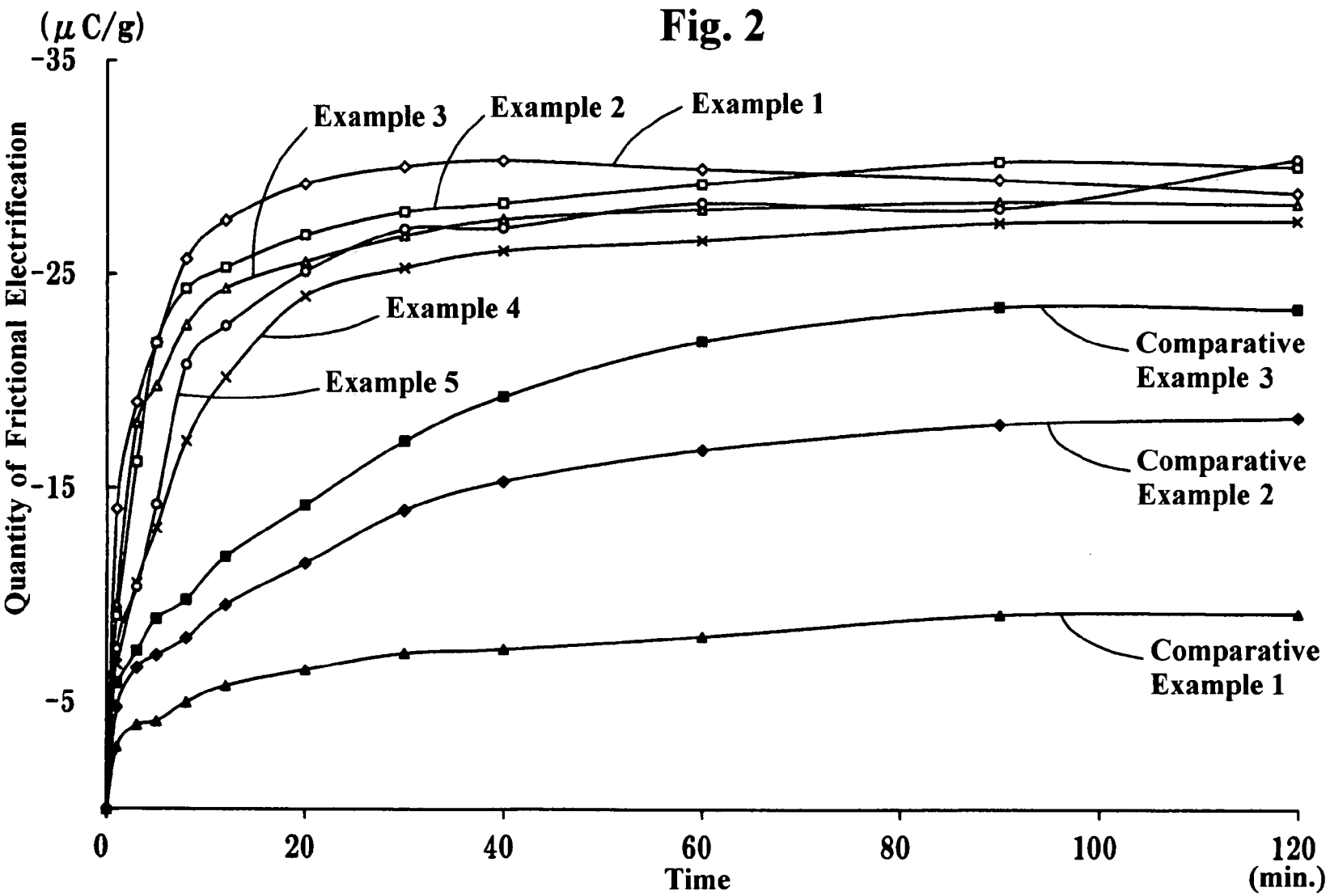
FIG. 2 is a graph shown a correlation between an agitation time of a developer prepared by using the toner for developing the electrostatic image that applies this invention and a quantity of the frictional electrification thereof.

After 52.5 g of the developer was put into a plastic bottle, it was agitated at 100 r.p.m. rotating speed by a boll mill to electrify. The elapsed time and the quantity of the frictional electrification were measured under the condition of 60% relative humidity at 20 degrees centigrade. The correlation between the agitation time and the quantity of the frictional electrification is shown in FIG. 2.

The developer had the excellent electrification stability and electrification durability. When the images were formed onto the paper using the developer by a commercial copying machine repetitiously, the images had no fogginess, well reproducibility of fine lines, no fluctuation of a shade thereof, good quality. Moreover, phenomenon of offset was not observed at all.

EXAMPLE 2

(1) Synthesis of the Monoazo Compound: Compound No. I-3

The preparing procedures performed in the paragraph (1) of Example 1 were repeated the same, except that 4-tert-butyl-2-aminophenol was used in place of 4-chloro-2-aminophenol used in Example 1, and 1-ethoxycarboamido-7-naphthol was used in place of 1-methoxycarboamido-7-naphthol used in Example 1, to obtain 98.6 g of the monoazo compound: Compound No. I-3 in Table 1.

Subsequently, the same confirmatory test of the sublimation performed in the paragraph (1) of Example 1 was repeated. The under side of the filter paper was observed. It was not found accretions of red sublimates from the monoazo compound, so it was confirmed the monoazo compound had no sublimation property.

(2) Synthesis of the Monoazo Metals-compound: Compound No. II-2

The same reaction procedures performed in the paragraph (2) of Example 1 were repeated except that the monoazo compound: Compound No. I-3 was used, and 38% of aluminum sulfate aqueous solution was used in place of the 38.9% iron(III) chloride aqueous solution used in Example 1. After the reaction, 13.7 g of 20% ammonium chloride aqueous solution was added to the reaction mixture. It was stirred with heating at 80 degrees centigrade for 8 hours. It was cooled until room temperature. The mixture was filtrated to take out a precipitate. It was washed with water and dried, to obtain 37.2 g of the monoazo metals-compound represented following formula: Compound No. II-2 in Table 2.

(II-2)

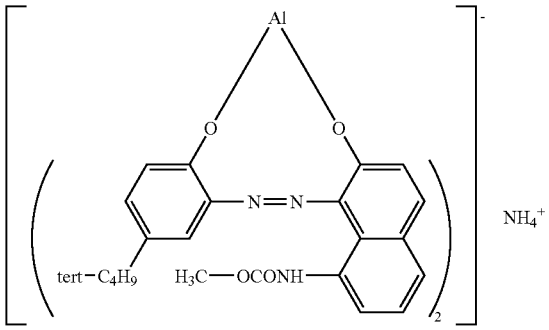

Subsequently, a same confirmatory test of the sublimation performed in the paragraph (2) of Example 1 was repeated. The under side of the filter paper was observed. It was not found accretions of sublimates from the monoazo-metals compound, so it was confirmed the monoazo metals-compound had no sublimation property.

(3) Preparation of the Toner for Developing the Electrostatic Image

The preparing procedures performed in the paragraph (3) of Example 1 were repeated the same, except that 1 part by weight of the monoazo compound: Compound No. II-2, 100 parts by weight of styrene-acryl copolymer as the charge control agent: CPR600B which is available from Mitsui Chemicals Corporation and 5 parts by weight of low grade polypropylene: VISCOL 550P which is available from Sanyo Kasei Industries Corporation as the resin for the toner, and 7 parts by weight of carbon black as the colorant: MA-100 which is available from Mitsubishi Chemical Corporation, to obtain the toner for developing the electrostatic image.

(4) Formation of Images onto the Paper

The preparing procedures performed in the paragraph (4) of Example 1 were repeated the same, except for using this obtained toner, to prepare the developer. The elapsed time and the quantity of the electrification were measured. The correlation between the agitation time and the quantity of the frictional electrification is shown in FIG. 2.

The developer had the excellent electrification stability and electrification durability. When the images were formed onto the paper using the developer by the commercial copying machine repetitiously, the images had no fogginess, well reproducibility of fine lines, no fluctuation of a shade thereof, good quality. Moreover, phenomenon of offset was not observed at all.

EXAMPLE 3

(1) Synthesis of the Monoazo Compound

The preparing procedures performed in the paragraph (1) of Example 1 were repeated the same, except that 4-fluoro-2-aminophenol was used in place of 4-chloro-2-aminophenol used in Example 1, to obtain the monoazo compound.

(2) Synthesis of the Monoazo Metals-Compound

The preparing procedures performed in the paragraph (2) of Example 1 were repeated the same, except that this monoazo compound was used, to obtain 36.9 g of the monoazo iron-compound represented following formula: Compound No. II-37.

(II-37)

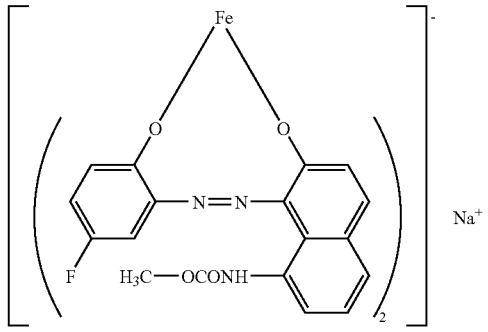

(3) Preparation of the Toner for Developing the Electrostatic Image

The preparing procedures performed in the paragraph (3) of Example 1 were repeated the same, except that 1 part by weight of this monoazo metals-compound: Compound No. II-37 as the charge control agent was used, to obtain the toner for developing the electrostatic image.

(4) Formation of Images onto the Paper

The preparing procedures performed in the paragraph (4) of Example 1 were repeated the same using this obtained toner, to prepare the developer. The elapsed time and the quantity of the electrification were measured. The correlation between the agitation time and the quantity of the frictional electrification is shown in FIG. 2.

The developer had the excellent electrification stability and electrification durability. When the images were formed onto the paper using the developer by the commercial copying machine repetitiously, the images had no fogginess, well reproducibility of fine lines, no fluctuation of a shade thereof, good quality. Moreover, phenomenon of offset was not observed at all.

EXAMPLE 4

(1) Synthesis of the Monoazo Compound: Compound No. I-11

The preparing procedures performed in the paragraph (1) of Example 1 were repeated the same, except that 3-methoxycarboamido-2-naphthol was used in place of 1-methoxycarboamido-7-naphthol used in Example 1, to obtain the monoazo compound: Compound No. I-11 in Table 1.

(2) Synthesis of the Monoazo Metals-compound: Compound No. II-14

The preparing procedures performed in the paragraph (2) of Example 1 were repeated the same, except that this monoazo compound: Compound No. I-11 was used, to obtain 35.7 g of the monoazo metals-compound represented following formula: Compound No. II-14 in Table 2.

(II-14)

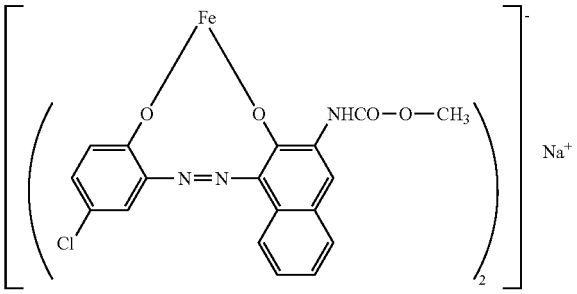

(3) Preparation of the Toner for Developing the Electrostatic Image

The preparing procedures performed in the paragraph (3) of Example 1 were repeated the same, except that 1 part by weight of this monoazo metals-compound: Compound No. II-14 as the charge control agent was used, to obtain the toner for developing the electrostatic image.

(4) Formation of Images onto the Paper

The preparing procedures performed in the paragraph (4) of Example 1 were repeated the same, except for using this obtained toner, to prepare the developer. The elapsed time and the quantity of the electrification were measured. The correlation between the agitation time and the quantity of the frictional electrification is shown in FIG. 2.

The developer had the excellent electrification stability and electrification durability. When the images were formed onto the paper using the developer by the commercial copying machine repetitiously, the images had no fogginess, well reproducibility of fine lines, no fluctuation of a shade thereof, good quality. Moreover, phenomenon of offset was not observed at all.

EXAMPLE 5

(1) Synthesis of the Monoazo Compound

The preparing procedures performed in the paragraph (1) of Example 2 were repeated the same, except that 4-sulfonamido-2-aminophenol was used in place of 4-tert-butyl-2-aminophenol used in Example 2, to obtain the monoazo compound.

(2) Synthesis of the Monoazo Metals-Compound

The preparing procedures performed in the paragraph (2) of Example 2 were repeated the same, except that this monoazo compound was used, to obtain 29.8 g of the monoazo aluminum-compound as the metals-compound represented following formula: Compound No. II-38.

(II-38)

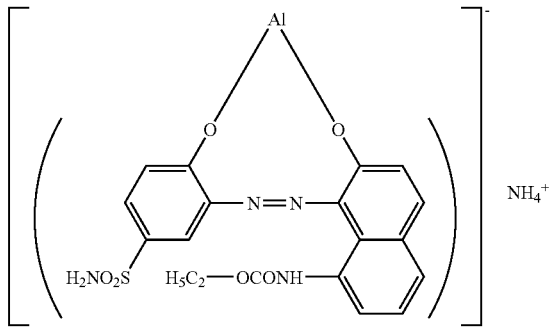

(3) Preparation of the Toner for Developing the Electrostatic Image

The preparing procedures performed in the paragraph (3) of Example 2 were repeated the same, except that 1 part by weight of this monoazo metals-compound: Compound No. II-38 as the charge control agent was used, to obtain the toner for developing the electrostatic image.

(4) Formation of Images onto the Paper

The preparing procedures performed in the paragraph (4) of Example 1 were repeated the same, expect for using this obtained toner, to prepare the developer. The elapsed time and the quantity of the electrification were measured. The correlation between the agitation time and the quantity of the frictional electrification is shown in FIG. 2.

The developer had the excellent electrification stability and electrification durability. When the images were formed onto the paper using the developer by the commercial copying machine repetitiously, the images had no fogginess, well reproducibility of fine lines, no fluctuation of a shade thereof, good quality. Moreover, phenomenon of offset was not observed at all.

COMPARATIVE EXAMPLE 1

The preparing procedures performed in Example 1 were repeated the same, except that a monoazo metals-compound represented following formula: Compound No. V-1 was used, to obtain a toner for developing the electrostatic image and to prepare a developer.

(V-1)

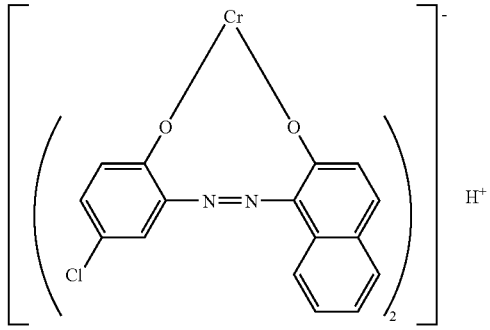

The elapsed time and the quantity of the electrification thereof were measured. The correlation between the agitation time and the quantity of the frictional electrification is shown in FIG. 2.

The developer had insufficient electrification stability and insufficient electrification durability. When the images were formed onto the paper using this developer by the commercial copying machine repetitiously, the images had fogginess. Therefore, the monoazo metals-compound: Compound No. V-1 is unsuitable for the charge control agent.

COMPARATIVE EXAMPLE 2

The preparing procedures performed in Comparative Example 1 were repeated the same, except that a monoazo metals-compound represented following formula: Compound No. V-2 was used in place of the monoazo metals-compound: Compound No.V-1 used in Comparative Example 1, to obtain the toner for developing the electrostatic image and to prepare the developer.

(V-2)

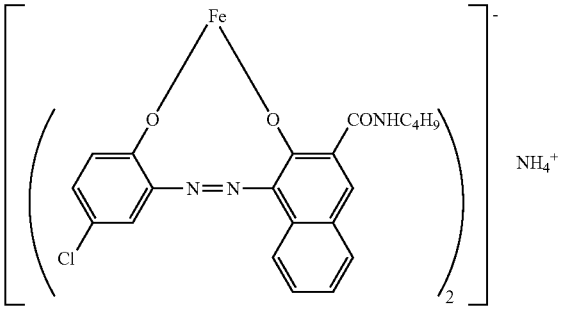

The elapsed time and the quantity of the electrification thereof were measured. The correlation between the agitation time and the quantity of the frictional electrification is shown in FIG. 2.

The developer had insufficient electrification stability and insufficient electrification durability. When the images were formed onto the paper using the developer by the commercial copying machine repetitiously, the images had fogginess. Therefore, the monoazo metals-compound: Compound No. V-2 is unsuitable for the charge control agent.

COMPARATIVE EXAMPLE 3

The preparing procedures performed in Comparative Example 1 were repeated the same, except that a monoazo metals-compound represented following formula: Compound No. V-3 was used in place of the monoazo metals-compound: Compound No.V-1 used in Comparative Example 1, to obtain the toner for developing the electrostatic image and to prepare the developer.

(V-3)

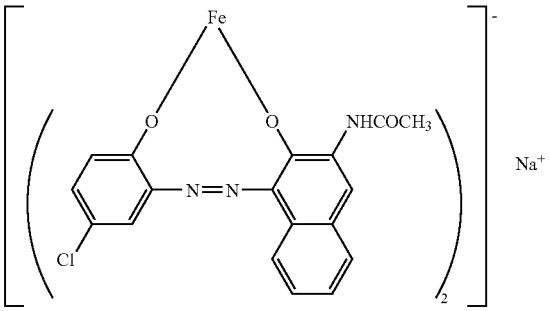

The elapsed time and the quantity of the electrification were measured. The correlation between the agitation time and the quantity of the frictional electrification is shown in FIG. 2.

The developer had insufficient electrification stability and insufficient electrification durability. When the images were formed onto the paper using the developer by the commercial copying machine repetitiously, the images had fogginess. Therefore, the monoazo metals-compound: Compound No. V-3 is unsuitable for the charge control agent.

COMPARATIVE EXAMPLE 4

The confirmatory test of the sublimation performed in the paragraph (1) of Example 1 was repeated the same, except for using a monoazo compound represented following formula: Compound No. V-4. When the under side of the filter paper was observed, it was stained red, so the sublimates from the monoazo compound were confirmed.

(V-4)

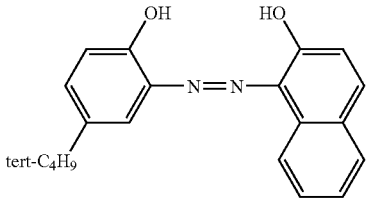

COMPARATIVE EXAMPLE 5

The confirmatory test of the sublimation performed in the paragraph (2) of Example 1 was repeated the same, except for using a monoazo iron-compound represented following formula: Compound No. V-5. When the under side of the filter paper was observed, it was stained red, so the sublimates from the monoazo iron-compound were confirmed.

(V-5)

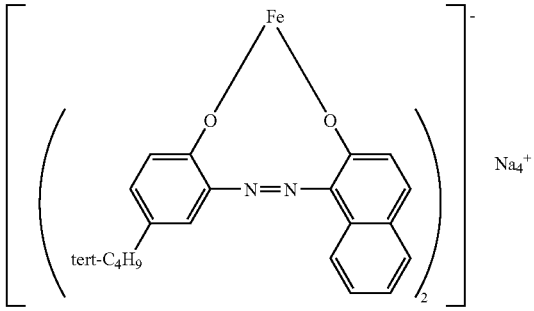

As it is mentioned above in detail, the charge control agent of the present invention includes the monoazo metals-compound synthesizing from the monoazo compound and is added into the toner when preparing it. The charge control agent has high affinity and dispersibility with the resin for the toner and thus is distributed into the toner homogeneously. Therefore, the charge control agent has the sharp distribution of the electrification and the extremely homogeneous quantity of the electrification and electrifies the toner negative electric charge. Such electric charge agent resists mechanical friction, a mechanical shock, an electric shock and an optical irradiation.

The charge control agent causes the toner the fast rise speed of the electrification and stability thereof for a long time maintain. Especially it has the excellent stability of the charge control properties at high temperature or high humidity. It does not include toxic heavy metals so that does not cause environmental pollution. Moreover, the result of Ames test thereof is negative and thus has high safety.

As the toner for developing the electrostatic image of the present invention contains the monoazo metals-compound, it has a sufficient electrification property, an excellent fixing property and non-offset property under a wide range of temperature and that has the excellent electrification stability under a high temperature, a high humidity, a change of temperature, a change of a humidity, elapsing of time, or repetitious using thereof. The toner has a property of a fast rise speed for electrification.

The images being formed onto the paper using the toner have stability, high resolution and vividness. When the charge control agent is mixed with the resin for the toner to prepare or the toner is fixed onto the paper, the sublimate is not generated to cause no environmental pollution.

The toner is used in developing images by the electro photography system and can form high resolution images.

What is claimed is:

1. A toner for developing an electrostatic image comprising:

a charge control agent comprising a monoazo compound represented by the following formula [I]

[I]

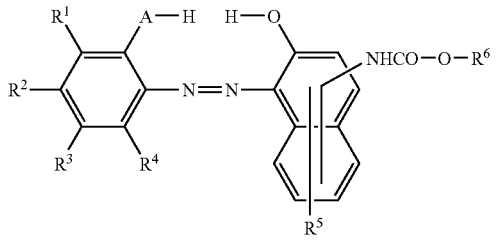

wherein each of $R^1$—, $R^2$—, and $R^4$— is a hydrogen atom, $R^3$— is selected from the group consisting of an alkyl group comprising a straight chain or a branch chain having 1 to 18 carbon atoms and a halogen atom, -A- is —O— or —COO—, —$R^5$ selected from the group consisting of a hydrogen atom, an alkyl group comprising a straight chain or a branch chain having 1 to 18 carbon atoms, —$R^6$ is selected from the group consisting of an alkyl group comprising a straight chain or a branch chain having 1 to 18 carbon atoms, and an aralkyl group, and a metal coordinating to the monoazo compound selected from the group consisting of Fe and Al;

a resin for the toner; and a colorant, wherein the monoazo compound is resistant to sublimation.

2. The toner according to claim 1, wherein said resin is at least one selected from the group consisting of styrene-acryl resin, styrene-maleic acid resin, styrene-(meth)acrylate copolymer and a polyester resin, having an acid value of 5 to 50 mgKOH/g thereof.

3. A toner for developing an electrostatic image comprising:

a charge control agent comprising a monoazo metals-compound represented by the following formula [II]

[II]

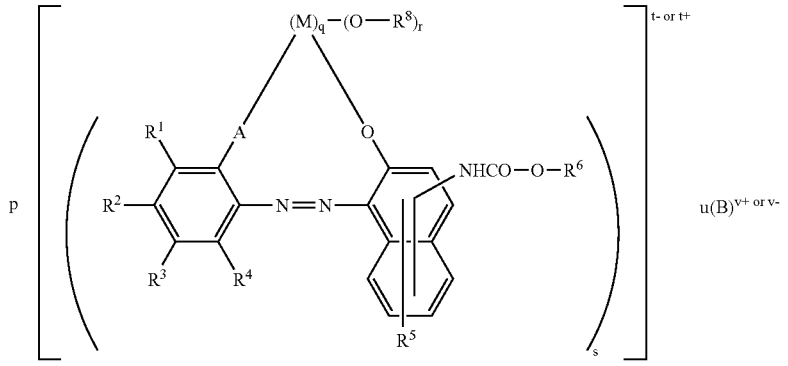

wherein each of $R^1$—, $R^2$—, and $R^4$— is a hydrogen atom, $R^3$— is selected from the group consisting of an alkyl group comprising a straight chain or a branch chain having 1 to 18 carbon atoms and a halogen atom, -A- is —O— or —COO—, —$R^5$ is selected from the group consisting of a hydrogen atom, an alkyl group comprising a straight chain or a branch chain having 1 to 18 carbon atoms, —$R^6$ is selected from the group consisting of an alkyl group comprising a straight chain or a branch chain having 1 to 18 carbon atoms and an aralkyl group, p is 1 or 2, $(M)_q$ wherein M is a bivalent, trivalent or tetravalent metallic element selected from the group consisting of Fe and Al, q is from 1 to 4, —$R^8$ is selected from the group consisting of an alkyl group having 1 to 8 carbon atoms and an aryl group, r is from 0 to 3, s is from 1 to 6, t is from 0 to 2, u is from 0 to 2, $(B)^{v+}$ comprises univalent or bivalent cation;

a resin for the toner; and a colorant, wherein the monoazo compound is resistant to sublimation.

4. The toner according to claim 3, wherein said resin is at least one selected from the group consisting of styrene-acryl resin, styrene-maleic acid resin, styrene-(meth)acrylate copolymer and a polyester resin, having an acid value of 5 to 50 mgKOH/g thereof.

* * * * *